United States Patent [19]

Ruf et al.

[11] Patent Number: 4,716,735

[45] Date of Patent: Jan. 5, 1988

[54] EXHAUST GAS TURBO-SUPERCHARGER FOR A VEHICLE ENGINE

[75] Inventors: Max Ruf, Obereisesheim; Erwin Korostenski, Oedheim, both of Fed. Rep. of Germany

[73] Assignee: Audi AG, Fed. Rep. of Germany

[21] Appl. No.: 898,616

[22] Filed: Aug. 21, 1986

[30] Foreign Application Priority Data

Sep. 13, 1985 [DE] Fed. Rep. of Germany ..... 3532695

[51] Int. Cl.[4] ..... F02B 37/00

[52] U.S. Cl. ..... 60/605.3; 180/291

[58] Field of Search ..... 60/605.3; 180/227, 291

[56] References Cited

U.S. PATENT DOCUMENTS

| | | | |
|---|---|---|---|
| 3,948,052 | 4/1976 | Merkle et al. | 60/605 |
| 4,432,205 | 2/1984 | Inoue et al. | 60/605 |
| 4,583,367 | 4/1986 | Kapfer et al. | 60/605 |

FOREIGN PATENT DOCUMENTS

| | | | |
|---|---|---|---|
| 52624 | 3/1982 | Japan | 60/605 |
| 52625 | 3/1982 | Japan | 60/605 |

*Primary Examiner*—Michael Koczo

*Attorney, Agent, or Firm*—Kane, Dalsimer, Kane, Sullivan & Kurucz

[57] ABSTRACT

An exhaust gas turbo-supercharger for a vehicle engine, which is connected via engine mounting to the chassis of the vehicle and is provided with an exhaust gas turbo-supercharger. The supercharger has a bearing housing 1 which is provided with lubricant and coolant passages 5 and 6 or 8 and 9, and which is designed to form an engine mounting. The housing is connected to the vehicle chassis 21 by an elastic bearing 20, and is flange-mounted to a surface 11 of the cylinder crank case 12. The lubricant and coolant passages 5 and 6 or 8 and 9 open in the abutment surface 10 of the bearing housing 1 against the cylinder crank case 12 and are in communication with the lubricant and coolant circuit 14 and 15 or 16 and 17 of the engine.

3 Claims, 2 Drawing Figures

EXHAUST GAS TURBO-SUPERCHARGER FOR A VEHICLE ENGINE

Figure 1:
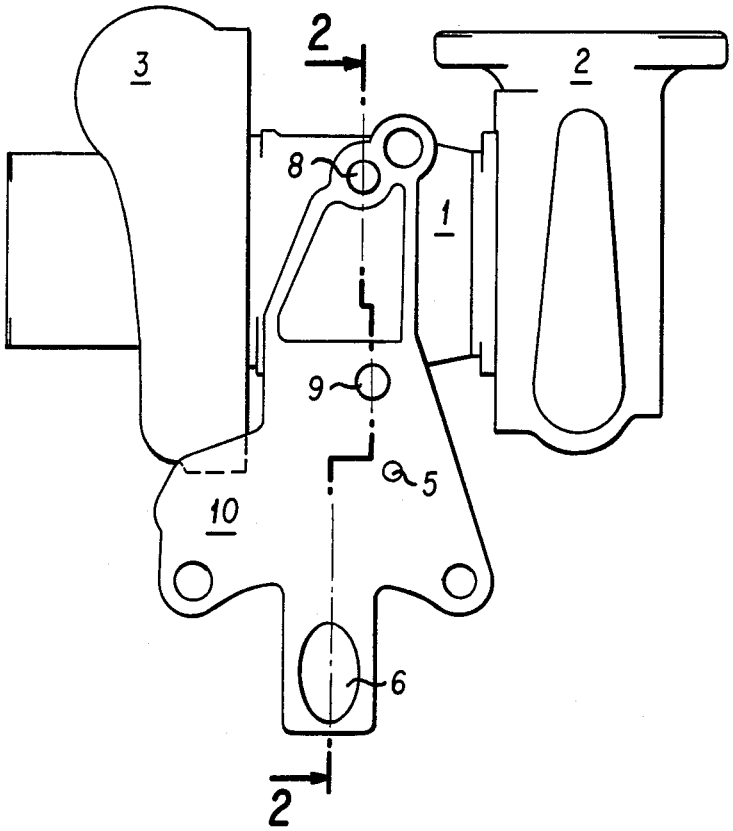

This invention relates to an exhaust gas turbo-supercharger for a vehicle engine.

Exhaust gas turbo-superchargers are normally fastened to the exhaust manifold of the engine. It is, however, also known for the exhaust gas turbo-supercharger to be fastened to an engine bracket or to a support arm of the engine. The lubricant and coolant passages in the supercharger housing are in this case connected via hoses and/or pipelines to the lubricant and coolant circuits of the engine. Due to the high temperatures of the turbine casting, the pipelines and pipe connections must be composed of stainless steel and the hose lines of high-grade plastic. These pipelines and hose lines and the appropriate connections are expensive. The design engineer has the further problem of accommodating these pipelines and hose lines in the engine compartment of the vehicle, where space is always very restricted. The result is that assembly also proves to be exceptionally difficult.

These problems may in part be overcome by arranging the turbo-charger in the cylinder head. Such an arrangement has, however, the disadvantage that connection of the turbo-supercharger of the inlet and outlet side to a plurality of cylinders is exceptionally difficult and the device cannot be retrofitted to increase the power of an existing engine by turbo-charging.

It is an object of the invention to provide an exhaust gas turbo-supercharger for a vehicle engine, in which the constructional cost, the space requirement, the increase in weight and the supplementary costs are reduced.

From one aspect the invention consists in an exhaust gas turbo-supercharger for a vehicle engine which is connected via engine mountings to the chassis of the vehicle, wherein the exhaust gas turbo-charger has a bearing housing which is provided with lubricant and coolant passages and has a turbine and supercharger casings placed laterally thereto, wherein the bearing housing forms an engine mounting and can be connected, on the one hand, via an elastic bearing to the vehicle chassis and, on the other hand, can be flange-mounted to a surface of the engine housing, and wherein at least one part of the lubricant and coolant passages opens on an abutment surface of the bearing housing for location against the engine housing and for communication with the lubricant and coolant circuit of the engine.

From another aspect the invention consists in an exhaust gas turbo-supercharger for a vehicle engine mountable in the engine compartment, including a bearing housing providing lubricant and coolant passages and mountings for the turbine and supercharger, the housing forming means for mounting the turbo-supercharger on the engine compartment and having an abutment surface for engaging a surface of the engine housing, at least part of each of the lubricant and coolant passages opening onto the abutment surfaces to communicate respectively with lubricant and coolant circuits of the engine.

The exhaust gas turbo-supercharger of the invention can be retrofitted in order to increase the power of an existing engine. By omitting the pipelines and hoselines for the lubricants and coolant and their connections, a considerable reduction of the constructional expenditure, a great saving on costs, and a simplified assembly is achieved. Further the bearing housing may form an engine mounting allowing an otherwise necessary engine bracket to be omitted resulting in a considerable reduction in weight.

Figure 2:
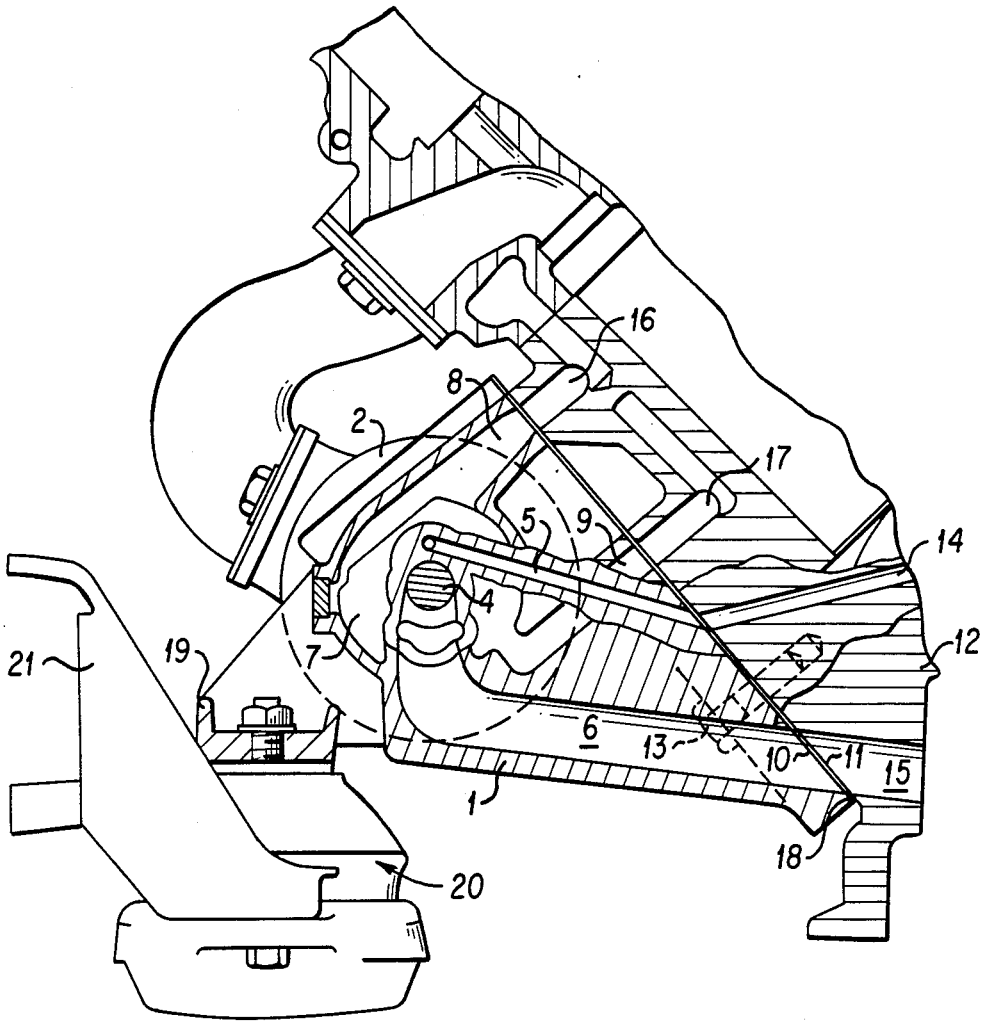

The invention may be performed in various ways and a specific example will now be described by way of example with reference to the accompanying drawings, in which:

FIG. 1 shows a view of an exhaust gas turbo-supercharger in a top plan view of the engagement surface with which the turbo-supercharger is fastened to the engine compartment, and FIG. 2 shows a section along line 2—2 in FIG. 1, in which the adjacent parts of the engine are illustrated in section.

The exhaust gas turbo-supercharger has a bearing housing 1, to which a turbine casing 2 and a compressor housing 3 are flange-mounted on opposite sides thereof. A shaft 4 is mounted in the bearing housing 1 to connect the turbine rotor to the supercharger rotor. The bearing housing 1 contains a lubricant inflow passage 5 and a lubricant outflow passage 6 to supply the bearings of the shaft 4 with lubricating oil. The housing also contains a coolant chamber 7, which is in communication with a coolant inflow passage 8 and a coolant outflow passage 9. The bearing housing 1 has a flat surface 10, which is held by means of bolts 13 to a corresponding counter-surface 11 of the cylinder crankcase 12 of an appropriate engine. The lubricant inflow and outflow passages 5 or 6 are connected to the lubricant circuit by passages 14 and 15 in the cylinder crank case 12, and the cooling water inflow and outflow passages 8 and 9 are connected to the coolant circuit of the engine via passages 16 and 17 in the cylinder crank case 12. A flat seal 18 is provided between the surfaces 10 and 11.

The bearing housing 1 has a flange 19, which is connected via an elastic engine bearing 20 to a part 21 which is fastened to the chassis of the motor vehicle.

Through the construction of the bearing housing 1 as an engine bracket or mounting and through the integration of the lubricant and coolant pipes in the bearing housing 1, a considerable reduction in weight and costs is achieved, the space requirement substantially reduced and the assembly considerably simplified.

What we claim is:

1. A motor vehicle driven by an internal combustion engine with an exhaust supercharger, said engine being connected via engine mountings to a vehicle chassis and including lubricant and coolant circuits, said supercharger comprising:

an exhaust gas turbine mounted in a turbine housing;

a compressor mounted in a compressor housing and driven by said turbine through a shaft; and a bearing housing between and connected to said turbine and compressor housings supporting said shaft and comprising lubricant and coolant passage means, wherein said bearing housing is connected on one side to the vehicle chassis and on another side to the engine and has an abutment surface abutting against a surface of the engine, said lubricant and coolant passage means opening onto the abutment surface for communication with the lubricant and coolant circuits of the engine.

2. A motor vehicle as claimed in claim 1 further including elastic bearing means connected to the bearing housing for connecting the bearing housing, and hence the supercharger, to the vehicle chassis.

3. A motor vehicle as claimed in claim 1 wherein the bearing housing constitutes at least part of said engine mounting.

* * * * *